US007188596B2

(12) United States Patent
Kohrs et al.

(10) Patent No.: US 7,188,596 B2
(45) Date of Patent: Mar. 13, 2007

(54) VANE-TYPE CAMSHAFT ADJUSTER

(75) Inventors: Mike Kohrs, Wilthen (DE); Hermann Golbach, Erlangen (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 11/146,698

(22) Filed: Jun. 7, 2005

(65) Prior Publication Data

US 2005/0268874 A1 Dec. 8, 2005

(30) Foreign Application Priority Data

Jun. 8, 2004 (DE) ..... 10 2004 027 950

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160; 29/888.1
See application file for complete search history.

(56) References Cited

U.S. PATENT DOCUMENTS 6,450,137 B2 * 9/2002 Ogawa ..... 123/90.17

FOREIGN PATENT DOCUMENTS

WO WO 2005121511 A1 * 12/2005

* cited by examiner

*Primary Examiner*—Ching Chang
(74) *Attorney, Agent, or Firm*—Ostrolenk, Faber, Gerb & Soffen, LLP

(57) ABSTRACT

A vane-type camshaft adjuster having a stator, and a rotor connectable to a camshaft. The rotor has a plurality of radially protruding blades inserted in respective blade grooves. The blade groove has groove side faces, a groove bottom and rounded transition regions between the groove side faces and the groove bottom. The transition regions undercut the groove side faces, wherein the rounded transition regions are configured, at least in part, as circular arc segments which undercut the groove bottom.

16 Claims, 2 Drawing Sheets

VANE-TYPE CAMSHAFT ADJUSTER

FIELD OF THE INVENTION

The invention relates to a vane-type camshaft adjuster having a stator and a rotor. The rotor can be connected to a camshaft. The rotor comprises a plurality of radially protruding blades inserted in blade grooves. The blades extend into the stator. A blade groove has groove side faces, a groove bottom and rounded transition regions between the groove side faces and the groove bottom, which transition regions undercut the groove side faces.

BACKGROUND OF THE INVENTION

Camshaft adjusters are used to alter the control times for the opening or closing of valves. The fixed angular relationship between the camshaft and the crankshaft which drives it is eliminated and the control times can be optimally set as a function of the rev speed and further parameters. Camshaft adjusters allow the camshaft to be twisted relative to the crankshaft.

Known vane-type camshaft adjusters have a rotor comprised of a plurality of radially protruding blades, which are urged by the force of a spring radially outward against a stator housing. A plurality of stops projecting radially inward are formed on the stator and limit the adjustment movement of the rotor in both rotational directions when the blades run against the stops. The blades bear against the stator with their leading edges, so that between, respectively, a blade side and the adjacent side of a stop of the stator, a chamber is formed, into which a fluid, generally the engine oil, is fed via a valve assigned to the camshaft adjuster. The stator serves, on the one hand, to separate and seal the fluid chambers, on the other hand to fix the angle of adjustment between the camshaft and the crankshaft.

The torque transmitted to the rotor rests, via the blades inserted in grooves, against the stator and, hydraulically, against the oil pad in the stator chambers. The force which thereby acts upon the blades engenders, for its part, reaction forces in the groove of the rotor. A force acts upon the groove edge on the external diameter of the rotor, the associated reaction force acts upon the opposite groove side in the groove bottom. These forces produce a combined tensile and flexural load in the two transitions between the groove side face and the groove bottom. In the corner region at the transition between the groove side face and the groove bottom, a dynamically generated stress concentration is produced by the notch effect. For this reason, the transition region, in conventional vane-type camshaft adjusters, is of rounded configuration, so that it undercuts the groove side face. However, considerable stresses still are generated in the corner region, which, under the usual operating loads, can be critical to the materials used.

SUMMARY OF THE INVENTION

The object of the invention is therefore to define a vane-type camshaft adjuster in which lower stresses are generated.

For the solution of this problem, it is envisaged, in a vane-type camshaft adjuster of the type stated in the introduction, that the rounded transition regions be configured, at least in part, as circular arc segments which undercut the groove bottom.

In the vane-type camshaft adjuster according to the invention, the groove bottom is not flatly configured, but rather the corner regions are shaped as circular arc segments which undercut the groove bottom. Only the middle region of the groove bottom is flat, since a spring rests there. The solution according to the invention has the advantage that only minor production-engineering changes are necessary. As a result of the optimized cross section of the blade groove, the load can be reduced, especially in the transition region, so that it is possible to dispense with higher grade materials, thereby producing cost savings.

In the vane-type camshaft adjuster according to the invention, the ratio of the distance of the lower end of the groove side face from the groove bottom relative to the groove width can be 0.4 to 0.55, more particularly approximately 0.48. With these parameters, the stress concentration in the transition region can already be considerably reduced. The groove width is sufficiently dimensioned, so that the blades inserted in the blade groove can withstand the occurring forces.

In the vane-type camshaft adjuster according to the invention, it is particularly preferred that the radius of the circular arc segments amounts to 0.5 times to 0.6 times the distance of the lower end of the groove side face from the groove bottom. More particularly, the radius can amount to 0.56 times the distance.

It can also be envisaged that the horizontal distance of the midpoint of a circular arc segment from the line of symmetry of the groove amounts to 0.3 times to 0.4 times the groove width. The value 0.35 is particularly preferred.

In the vane-type camshaft adjuster according to the invention, the vertical distance of the midpoint of the circular arc segment to the groove bottom can amount to 0.90 times to 0.99 times the radius of the circular arc segment. The value 0.95 is particularly preferred. The quoted geometric values and parameters are not rigid limits, they can be varied provided that the desired stress reduction is thereby obtained.

In the vane-type camshaft adjuster according to the invention, a further optimization of the generated stresses can be obtained if a groove side face has a relief notch. In this embodiment of the invention, the geometric optimization is not limited to the rounded transition region, since the groove side face likewise has an optimized shape. As a result of the relief notch, the force flow, starting from the upper groove edge in the direction of the rotor middle, is gently diverted in a wide arc, so that no high stress concentration is obtained in the groove bottom. The generated forces and stresses are more evenly distributed as a result of the relief notch, so that the material load is lessened.

It is particularly preferred that the relief notch is distanced from the groove-bottom-side end of the groove side face. The blade thus bears against the upper, outer end of the groove. In addition, between the relief notch and the rounded region close to the groove bottom, the blade bears against the groove side faces, so that it is guided in the groove.

A particularly effective stress reduction can be obtained if the relief notch of the vane-type camshaft adjuster according to the invention is configured, at least in part, as a circular arc segment. If a circular arc segment is used, corners, which could lead to an increase in stress, are dispensed with.

In a further embodiment of the invention, it can be envisaged that the groove-bottom-side end of the relief notch runs approximately perpendicularly and the opposite end of the relief notch runs tangentially to the groove side face. A rotor of such construction enables a considerable reduction in stresses to once again be obtained.

It can also be envisaged that the radius of the circular arc segment in the region of the groove bottom is chosen such that it leads tangentially into the circular arc segment of the relief notch. Consequently, through the edging of the two circular arc segments, an envelope having a certain radius can be generated.

Optimal stress ratios can be obtained if the radius of the circular arc segment in the region of the relief notch amounts to 0.75 times to 0.85 times the groove height. A value of 0.81 is particularly preferred.

In the vane-type camshaft adjuster according to the invention, the radius of the circular arc segment in the region of the groove bottom can amount to about 0.20 times to 0.28 times the radius of the circular arc segment in the region of the relief notch. A value of 0.24 is particularly preferred.

Other features and advantages of the present invention will become apparent from the following description of the invention which refers to the accompanying drawings.

DETAILED DESCRIPTION OF THE INVENTION

Figure 1:
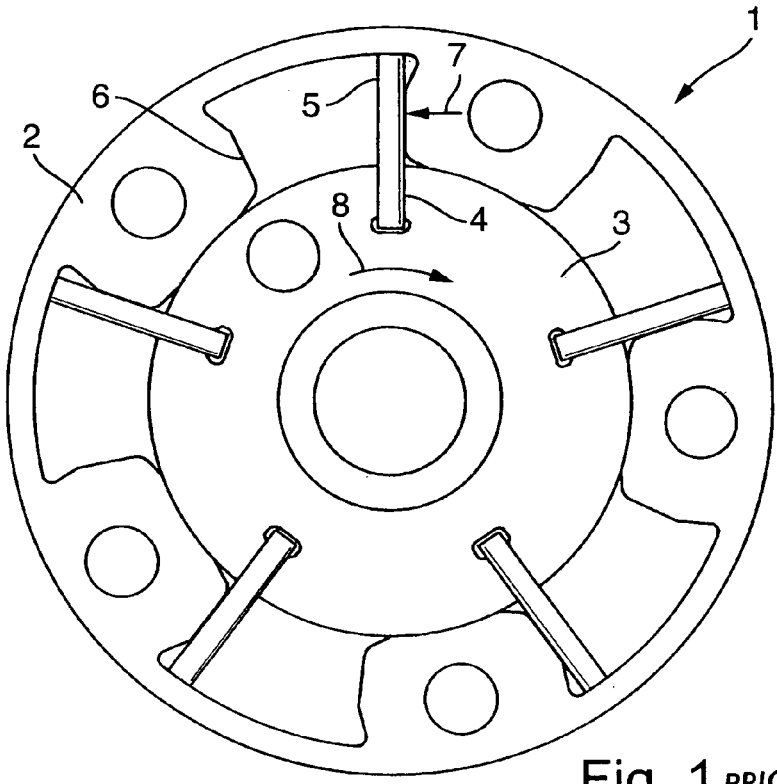
Fig. 1 PRIOR ART
FIG. 1 shows a conventional vane-type camshaft adjuster having a stator and a rotor with inserted blades.

FIG. 1 shows a conventional vane-type camshaft adjuster 1 comprising a stator 2, and a rotor 3 having a plurality of blades 5 inserted in blade grooves 4 in the rotor.

The stator 2 is part of a chain or belt drive, whereby the rotation of the crankshaft is transmitted by a chain or a belt, via the stator 2 and the rotor 3, to a camshaft. The stator 2 has projections 6, which serve as stops for the blades 5. In FIG. 1, the blade 5 is in an end position. In the rotor 3, on the left and right side of each blade groove 4, there are bores, through which a fluid can flow in or out of a chamber alongside the blade 5. As a result of the inflowing or outflowing fluid, a relative rotation between the rotor 3 and the stator 2, and thus between the crankshaft and the camshaft of an internal combustion engine, is obtained.

The blade 5 is acted upon by the force 7 represented as an arrow, which is opposed by the torque 8 acting upon the shaft of the rotor 3.

Figure 2:
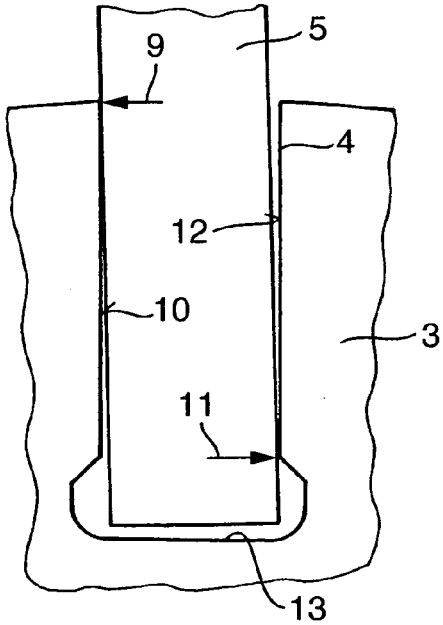
Fig. 2 PRIOR ART
FIG. 2 shows an enlarged detail from FIG. 1 in the region of a blade groove.

FIG. 2 shows an enlarged detail from FIG. 1 in the region of the blade groove 4.

The force acting upon the blade 5 engenders a reaction force 9 at the outer end of the groove side face 10. At the same time, a further reaction force 11 is engendered on the opposite groove side face 12. The forces 9, 11 produce a combined tensile and flexural load in the region of the transitions of the groove side faces 10, 12 in the direction of the groove bottom 13. Although the transition between the groove bottom 13 and the groove side faces 10, 12 is configured as an undercut in the groove side face, in the corner regions, especially in the corner represented on the left in FIG. 2, very high stresses are generated in the material.

Figure 3:
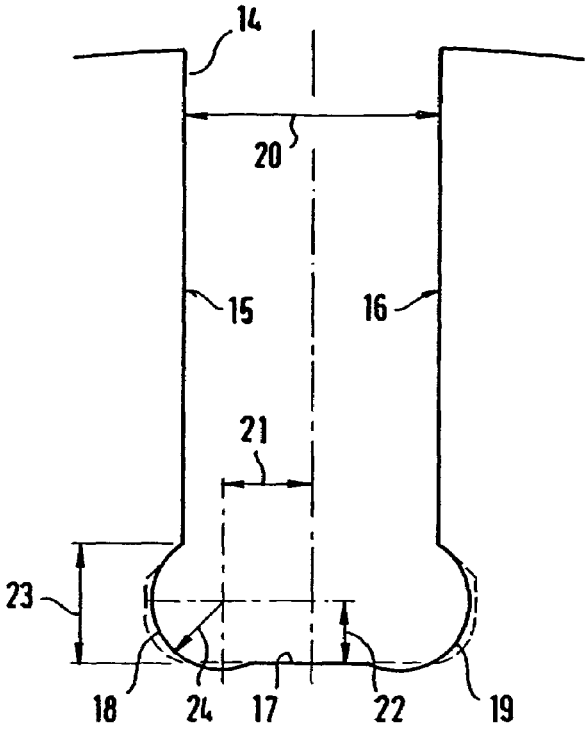
FIG. 3 shows the blade groove of a camshaft adjuster according to a first illustrative embodiment of the invention.

FIG. 3 shows the blade groove of a camshaft adjuster according to the first illustrative embodiment of the invention.

The contour of the conventional blade groove according to FIG. 2 is represented in dashed representation in FIG. 3 for comparison.

In the blade groove 14 represented in FIG. 3, the rounded transition regions between the groove side faces 15, 16 and the groove bottom 17 are configured as circular arc segments 18, 19, which undercut, at least in part, the groove bottom 17. Calculations have shown that the optimized geometry represented in FIG. 3 produces a 13% reduction in the maximum principal stress.

In the represented illustrative embodiment, the ratio of the distance of the lower end of the groove side face 15, 16 from the groove bottom 17 relative to the width of the blade groove 14 is about 0.48. The radius of the circular arc segments 18, 19 amounts to 0.56 times the distance of the lower end of the groove side faces 15, 16 from the groove bottom 17. The horizontal distance of the midpoint of the circular arc segment 18, 19 from the line of symmetry of the blade groove 14 amounts to 0.35 times the width of the blade groove 14. The vertical distance of the midpoint of the circular arc segments 18, 19 to the groove bottom 17 amounts to 0.95 times the radius of the circular arc segments 18, 19.

Figure 4:
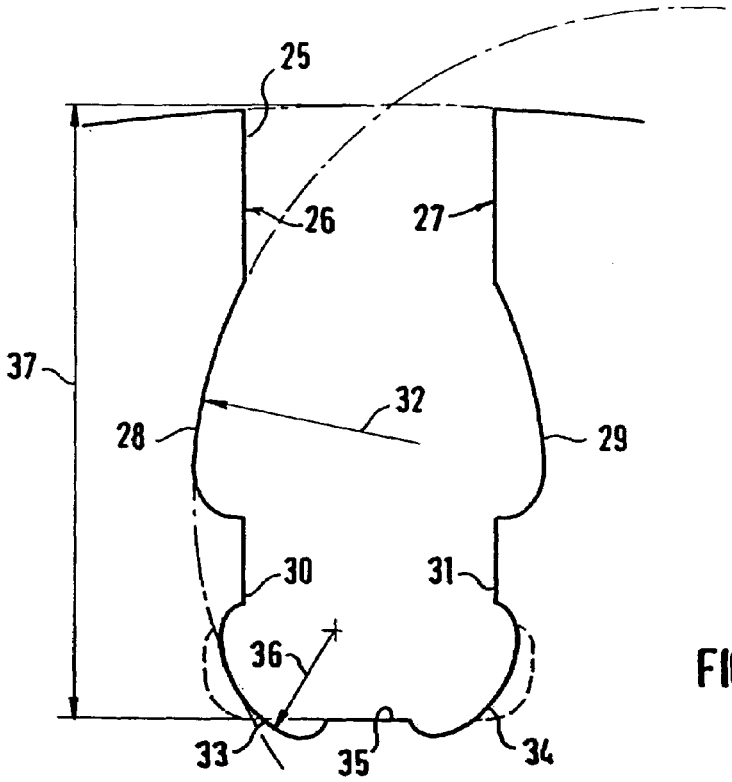
FIG. 4 shows the blade groove of a camshaft adjuster according to a second illustrative embodiment of the invention.

FIG. 4 shows the blade groove of a camshaft adjuster according to a second illustrative embodiment of the invention.

Unlike in the illustrative embodiment shown in FIG. 3, the blade groove has, in the region of the groove side faces 26, 27 relief notches 28, 29. The relief notches 28, 29 are distanced from the groove-bottom-side end 30, 31 of the groove side faces 26, 27, so that a blade in this region bears and is guided against the groove side faces 26, 27.

The relief notches 28, 29 are configured, at least in part, as a circular arc segment having a radius 32. The groove-bottom-side end of the relief notch 28, 29, the lower end in FIG. 4, runs approximately perpendicularly to the groove side face 26, 27. The opposite end, the upper end of the relief notch 28, 29 in FIG. 4, runs tangentially to the groove side face 26, 27. Since the radius 32 of the relief notches 28, 29 conforms, at least in part, to the radius of the circular arc segments 33, 34 in the region of the groove bottom 35, the force flow, starting from the upper groove edge, is diverted in a wide arc, so that in the corner regions, especially close to the circular arc segment 33 represented on the left in FIG. 4, the generation of stress concentrations is prevented.

The radius 36 of the circular arc segment 33, 34 in the region of the groove bottom 35 is chosen such that the circular arc segment 33, 34 leads tangentially into the circular arc segment of the relief notch 28, 29.

The radius 32 of the circular arc segment in the region of the relief notch 28, 29 amounts, in the represented illustrative embodiment, to 0.81 times the groove height 37. The radius 36 of the circular arc segment 33, 34 in the region of the groove bottom 35 amounts to 0.24 times the radius 32 of the circular arc segment in the region of the relief notch 28, 29.

Calculations have revealed that the optimized geometry according to the second illustrative embodiment produces a 30% reduction in stress.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A vane-type camshaft adjuster comprising:

a stator;

a rotor connectable to a camshaft and rotatable with respect to the stator; the rotor comprising a plurality of blade grooves therein, and respectively radially protruding blades inserted in the blade grooves and extending into the stator for cooperating with the stator;

each blade groove having opposed groove side faces which are circumferentially spaced apart, a groove bottom at the bottom of the blade groove and rounded transition regions between the groove side faces and the groove bottom, the transition regions being shaped to undercut the groove side faces and configured, at least in part, as circular arc segments shaped to undercut the groove bottom.

2. The vane-type camshaft adjuster as claimed in claim 1, wherein the groove side face has a lower end and the ratio of the distance of the lower end of the groove side face from the groove bottom relative to the groove width is 0.4 to 0.55.

3. The vane-type camshaft adjuster as claimed in claim 2, wherein the radius of the circular arc segments is 0.5 times to 0.6 times the distance of the lower end of the groove side face from the groove bottom.

4. The vane-type camshaft adjuster as claimed in claim 3, wherein a horizontal distance of a midpoint of the circular arc segment from the line of symmetry of the groove is 0.3 times to 0.4 times the groove width.

5. The vane-type camshaft adjuster as claimed in claim 4, wherein the vertical distance of the midpoint of the circular arc segment to the groove bottom is 0.90 times to 0.99 times the radius of the circular arc segment.

6. The vane-type camshaft adjuster as claimed in claim 1, wherein the radius of the circular arc segments is 0.5 times to 0.6 times the distance of the lower end of the groove side face from the groove bottom.

7. The vane-type camshaft adjuster as claimed in claim 1, wherein a horizontal distance of a midpoint of the circular arc segment from the line of symmetry of the groove is 0.3 times to 0.4 times the groove width.

8. The vane-type camshaft adjuster as claimed in claim 1, wherein a vertical distance of a midpoint of the circular arc segment to the groove bottom is 0.90 times to 0.99 times the radius of the circular arc segment.

9. The vane-type camshaft adjuster as claimed in one of claim 1, wherein at least one of the groove side faces has a relief notch.

10. The vane-type camshaft adjuster as claimed in claim 9, wherein the relief notch is spaced a distance from the groove-bottom-side end of the groove side face.

11. The vane-type camshaft adjuster as claimed in claim 10, wherein the relief notch is configured, at least in part, as a circular arc segment.

12. The vane-type camshaft adjuster as claimed in claim 9, wherein the relief notch is configured, at least in part, as a circular arc segment.

13. The vane-type camshaft adjuster as claimed in claim 12, wherein the groove-bottom-side end of the relief notch runs approximately perpendicularly to and the opposite end of the relief notch runs tangentially to the groove side face.

14. The vane-type camshaft adjuster as claimed in claim 12, wherein the radius of the circular arc segment in the region of the groove bottom is such that it leads tangentially into the circular arc segment of the relief notch.

15. The vane-type camshaft adjuster as claimed in one of claim 12, wherein the radius of the circular arc segment in the region of the relief notch is 0.75 times to 0.85 times the groove height.

16. The vane-type camshaft adjuster as claimed in claim 12, wherein the radius of the circular arc segment in the region of the groove bottom is about 0.20 times to 0.28 times, the radius of the circular arc segment in the region of the relief notch.

* * * * *